United States Patent [19]

Fujimura et al.

[11] Patent Number: 4,765,300

[45] Date of Patent: Aug. 23, 1988

[54] FUEL SUPPLY CONTROL METHOD FOR INTERNAL COMBUSTION ENGINES AFTER STARTING IN HOT STATE

[75] Inventors: Akira Fujimura; Yoshio Wazaki, both of Wako, Japan

[73] Assignee: Honda Giken Kogyo K.K., Tokyo, Japan

[21] Appl. No.: 119,818

[22] Filed: Nov. 12, 1987

[30] Foreign Application Priority Data

Dec. 27, 1986 [JP] Japan ..... 61-310654

[51] Int. Cl.[4] ..... F02D 41/06

[52] U.S. Cl. ..... 123/491; 123/179 L

[58] Field of Search ..... 123/179 G, 179 L, 491

[56] References Cited

U.S. PATENT DOCUMENTS 4,582,036 4/1986 Kiuchi et al. ..... 123/491

FOREIGN PATENT DOCUMENTS 217747 12/1983 Japan .

234237 10/1986 Japan .

*Primary Examiner*—Tony M. Argenbright

*Attorney, Agent, or Firm*—Arthur L. Lessler

[57] ABSTRACT

A fuel supply control method for an internal combustion engine, including the steps of effecting after-start fuel increasing control wherein an initial value of a fuel increment is set to a value dependent upon a temperature of the engine upon generation of a predetermined control signal immediately after the start of the engine, the fuel increment is progressively decreased from the set initial value in synchronism with subsequent generation of the predetermined control signal, and a fuel quantity corrected by the progressively decreased fuel increment is supplied to the engine, and effecting air-fuel ratio feedback control, which is executed on condition that a predetermined feedback control condition is fulfilled after the start of the engine, wherein a correction coefficient is set to a value dependent upon the concentration of an ingredient in engine exhaust gases, sensed by an $O_2$ sensor, and a fuel quantity corrected by the set correction coefficient is supplied to the engine. The initial value of the fuel increment is set to smaller values as the engine temperature is higher, and set to a predetermined lower limit if the initial value set depending upon the engine temperature is smaller than the predetermined lower limit. The feedback control is effected by correcting a fuel quantity to be supplied to the engine by the fuel increment together with the correction coefficient insofar as the predetermined feedback control condition is fulfilled, when the engine temperature is higher than a predetermined value at the start of the engine.

3 Claims, 6 Drawing Sheets

FUEL SUPPLY CONTROL METHOD FOR INTERNAL COMBUSTION ENGINES AFTER STARTING IN HOT STATE

BACKGROUND OF THE INVENTION

This invention relates to a fuel supply control method for internal combustion engines after starting, and more particularly to a method of this kind which is intended to control a fuel quantity supplied to an internal combustion engine immediately after being started in a hot state.

Conventionally, fuel supply control methods for internal combustion engines after starting have been proposed by the assignee of the present application, wherein air-fuel ratio feedback control is effected by supplying a fuel quantity corrected by the use of an $O_2$ feedback correction coefficient having its value determined in response to the concentration of an ingredient in exhaust gases sensed by an exhaust gas ingredient concentration sensor arranged in an exhaust system of the engine when the sensor is in an activated state, and an initial value of a fuel increment is set as a function of the engine temperature upon generation of a predetermined control signal immediately after the start of the engine, subsequently the set initial value of the fuel increment is progressively decreased each time the predetermined control signal is generated, and a fuel quantity is calculated by the use of the thus decreased fuel increment and supplied to the engine in synchronism with generation of the predetermined control signal.

One of the above fuel supply control methods is such that the feedback control based upon the $O_2$ feedback correction coefficient is started when the correction of the fuel quantity by the above fuel increment is terminated, that is, when the fuel increment is decreased to a value of 1.0 (Japanese Provisional Patent Publication (Kokai) No. 58-217747, hereinafter called "Prior Art 1"). Another method is such that when the condition for starting the air-fuel ratio feedback control is fulfilled, the fuel increment is set to 1.0 and the feedback control is started by the use of the $O_2$ feedback correction coefficient (Japanese Provisional Publication (Kokai) No. 61-234237, hereinafter called "Prior Art 2").

However, these prior art methods have the disadvantage that the fuel supply control for an engine after starting cannot be effected in a proper manner if the temperature of the engine immediately after starting is so high that gas bubbles are contained in the fuel within fuel injection valves to be supplied to the engine. More specifically, in the case where the engine is once stopped and restarted again soon, the temperature within the fuel injection valves is often higher than a value at which gas bubbles can be formed in the fuel. Accordingly, the gas bubbles contained in the fuel are also injected into the intake pipe together with the fuel, resulting in a lean mixture being supplied to the engine. If Prior Art 1 is applied to the engine after starting in such hot state, the air-fuel ratio feedback control is not started until the correction of the fuel quantity by the fuel increment is completed, even after the feedback control starting condition is fulfilled, thereby being unable to prevent the mixture from being leaned due to the gas bubbles contained in the fuel. On the other hand, if Prior Art 2 is applied to the hot restarted engine, the air-fuel feedback control is started immediately upon fulfilment of the feedback control starting condition after the start of the engine, but during the feedback control the correction of the fuel quantity by the fuel increment is not effected. As a result, the value of the $O_2$ feedback correction coefficient is automatically controlled to an extreme value enriching the mixture so as to make up for an amount of fuel to be increased by the fuel increment as well as for the leaning of the mixture due to the presence of gas bubbles in the fuel. This causes the phenomenon that the mixture supplied to the engine becomes overrich immediately after all the gas bubbles injected together with the fuel and burnt have been emitted, resulting in a delay in bringing the correction coefficient to a proper value, and hence preventing stable driveability of the engine from being attained after the start of the engine.

SUMMARY OF THE INVENTION

It is therefore the object of the invention to provide a fuel supply control method for an internal combustion engine after starting in a hot state, which is capable of preventing the mixture from being leaned and also securing required driveability of the engine through stable air-fuel ratio feedback control, after starting of the engine in a hot start.

To attain the above object, the present invention provides a method of controlling the supply of fuel to an internal combustion engine, including the steps of effecting after-start fuel increasing control wherein an initial value of a fuel increment is set to a value dependent upon a temperature of the engine upon generation of a predetermined control signal immediately after the start of the engine, the fuel increment is progressively decreased from the set initial value in synchronism with subsequent generation of the predetermined control signal, and a fuel quantity corrected by the progressively decreased fuel increment is supplied to the engine, and effecting air-fuel ratio feedback control, which is executed insofar as a predetermined feedback control condition is fulfilled after the start of the engine, wherein a correction coefficient has a value thereof set to a value dependent upon the concentration of an ingredient in exhaust gases emitted from the engine, sensed by sensor means arranged in an exhaust system of the engine, and a fuel quantity corrected by the set correction coefficient is supplied to the engine.

The method according to the invention is characterized by the improvement comprising the steps of: (a) setting the initial value of the fuel increment to smaller values as the temperature of the engine is higher; (b) setting the initial value of the fuel increment to a predetermined lower limit if the initial value set depending upon the temperature of the engine is smaller than the predetermined lower limit; and (c) effecting the air-fuel ratio feedback control by correcting a fuel quantity to be supplied to the engine by the fuel increment together with the correction coefficient insofar as the predetermined feedback control condition is fulfilled, when the temperature of the engine is higher than a predetermined value at the start of the engine.

The predetermined value of the temperature of the engine is a value above which gas bubbles can be formed in fuel to be supplied to the engine.

Preferably, the temperature of the engine is the temperature of intake air being supplied to the engine.

The above and other objects, features, and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
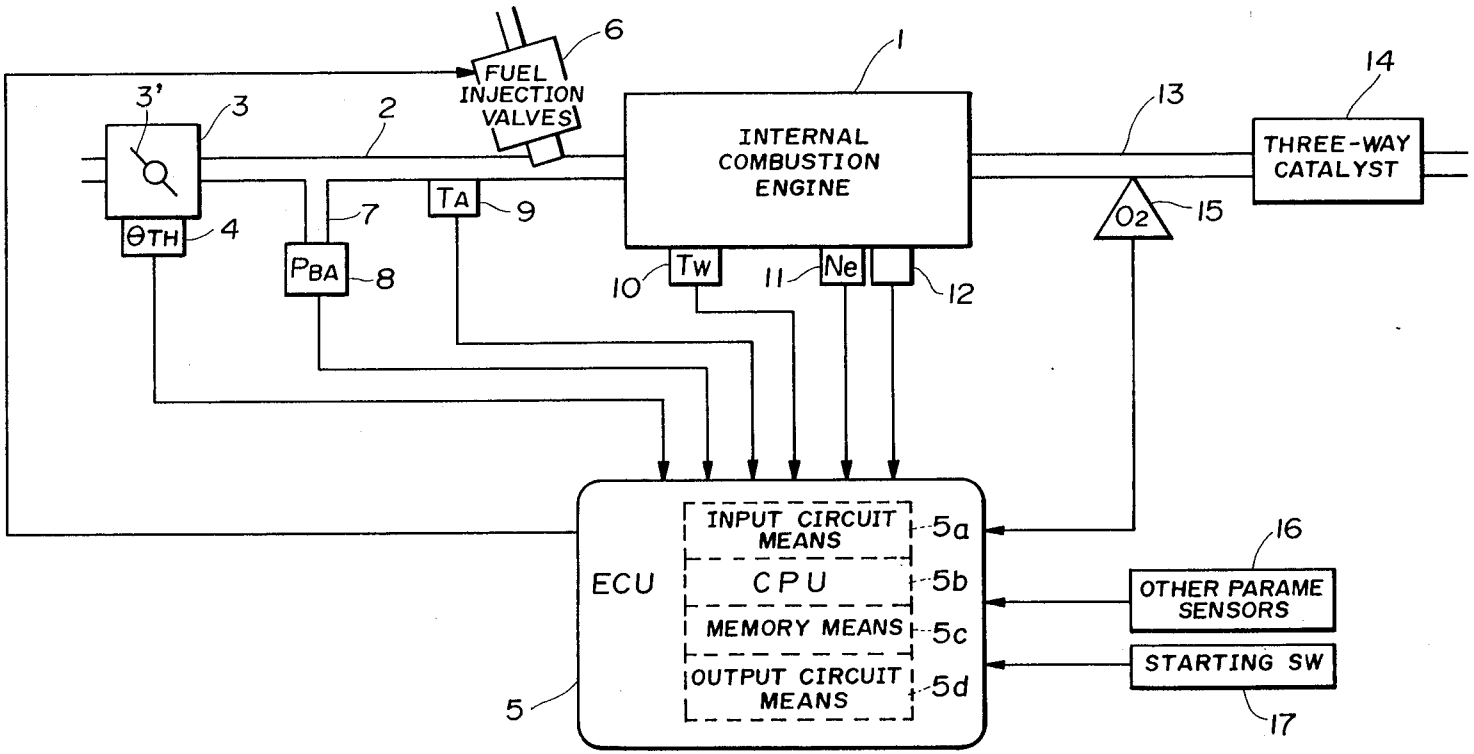
FIG. 1 is a block diagram of the whole arrangement of a fuel supply control system for an internal combustion, which carries out the method according to the invention.

Referring first to FIG. 1, there is shown the whole arrangement of a fuel supply control system for an internal combustion engine, which executes the method according to the invention. Connected to the engine 1 which may be a four-cylinder type is an intake pipe 2. Arranged at an intermediate portion of the intake pipe 2 is a throttle body 3 in which a throttle valve 3' is mounted. Connected to the throttle valve 3' is a throttle valve opening ($\theta$th) sensor 4 which converts the sensed throttle valve opening into an electric signal and delivering same to an electronic control unit (hereinafter called "the ECU") 5.

Fuel injection valves 6, only one of which is shown, are inserted into the interior of the intake pipe 2 at locations intermediate between the cylinder block of the engine 1 and the throttle body 3 and each arranged slightly upstream of an intake valve, not shown, of a corresponding one of the engine cylinders. The fuel injection valves 6 are conencted to a fuel pump, not shown, and electrically connected to the ECU 5 to have their valve opening periods controlled by control signals therefrom.

An intake pipe absolute pressure (PBA) sensor 8 is communicated via a pipe 7 with the interior of the intake pipe 2, for sensing absolute pressure within the intake pipe 2 and supplying an electric signal indicative of the sensed absolute pressure to the ECU 8 to which it is electrically connected.

An intake air temperature TA sensor 9 is arranged in the intake pipe 2 at a location downstream of the intake pipe absolute pressure sensor 8, for converting the sensed intake air temperature into an electric signal and sending same to the ECU 5.

The cylinder block of the engine 1 is provided therein with an engine coolant temperature (TW) sensor 10 for sensing the temperature of engine coolant. The sensor 10 is formed of a thermistor, for instance, and is embedded in a peripheral wall of one of the engine cylinders filled with engine coolant, and electrically connected to the ECU 5 for supplying an electric signal indicative of the sensed coolant temperature thereto.

Arranged in facing relation to a camshaft or a crankshaft of the engine 1, neither of which is shown, are an engine rotational speed (Ne) sensor 11 for sensing the rotational speed of the engine and a cylinder-discriminating sensor 12 for sensing the position of a particular one of the engine cylinders, the sensors being electrically connected to the ECU 8 for supplying respective electric signals indicative of the sensed rotational speed and particular cylinder position thereto. The engine rotational speed sensor 11 is adapted to generate a pulse of a crank angle position signal (hereinafter called "the TDC signal") at each of predetermined crank angles in advance of a top dead center (TDC) corresponding to the start of a suction stroke of each of the cylinders each time the engine crankshaft rotates through 180 degrees, and the cylinder-discriminating sensor 12 is adapted to generate a pulse of a cylinder-discriminating signal at a predetermined crank angle position of the particular engine cylinder, pulses of the TDC signal and the cylinder discriminating signal being supplied to the ECU 5.

Arranged in an exhaust pipe 13 of the engine 1 is a three-way catalyst 14 for purifying HC, CO, and $NO_x$ ingredients contained in exhaust gases emitted from the engine 1. An oxygen concentration sensor ($O_2$ sensor) 15 is inserted into the interior of the exhaust pipe 3 at a location downstream of the three-way catalyst 14 for sensing the concentration of oxygen in the exhaust gases and electrically connected to the ECU 5.

Further connected to the ECU 5 are other sensors 16 for sensing other engine operating parameters such as the output voltage of a battery, not shown, provided for the engine, and a starting switch 17 of the engine 1, the position of which indicates the operation of a starting motor, not shown, of the engine 1, so that the ECU 5 is supplied with electric signals indicative of the sensed other engine operating parameters as well as the on-off state of the starting switch 17.

The ECU 5 comprises input circuit means 5*a* having functions, e.g. of shaping the waveforms of input signals from part of the aforementioned various sensors and the starting switch 17, shifting the levels of output voltages from part of the sensors into a predetermined level, and converting analog signals from part of the sensors into digital signals, a central processing unit (hereianfter called "the CPU") 5*b*, memory means 5*c* storing various control programs executed within the CPU 5*b* and for storing results of various computations also executed within the CPU 5*b*, and output circuit means 5*d* for supplying driving signals to the fuel injection valves 6.

Details of the control method according to the invention executed by the above described control system will now be explained.

Figure 2:
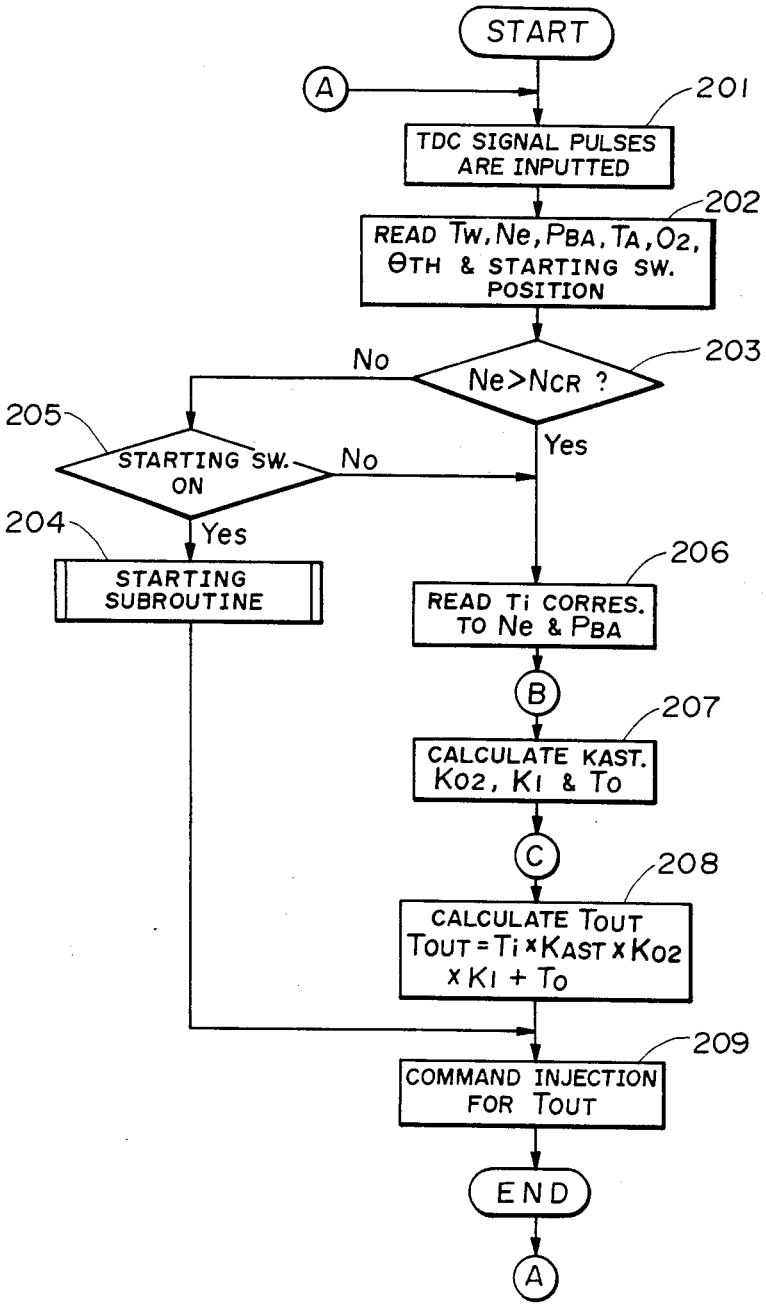
FIG. 2 is a flowchart of a manner of operation of the control system of FIG. 1.

FIG. 2 shows a program for calculating the valve opening period of the fuel injection valves, which is executed in synchronism with each pulse of the TDC signal. When the starting switch 17 is turned on, the engine is started and TDC signal pulses are inputted to the ECU 5 (step 201). Each time a pulse of the TDC signal is inputted to the ECU 5, sensed values of the engine coolant temperature TW, the intake pipe absolute pressure PBA, the intake air temperature TA, the oxygen concentration $O_2$, the throttle valve opening θth, the on-off state of the starting switch 17, etc., which are inputted to the ECU 5, are read by the CPU 5b at a step 202. Also at this step 202, a period of time elapsed from an immediately preceding pulse of the TDC signal to a present pulse thereof is counted, and a value of the engine rotational speed Ne calculated from the counted time period is read by the CPU 5b. Then, it is determined at a step 203 whether or not the engine rotational speed Ne has increased above a predetermined cranking value NCR (e.g. 400 rpm). If the answer to the question of the step 203 is negative or No, the program proceeds to a step 205 to determine whether or not the starting switch 17 is on. If the answer is affirmative or Yes, that is, if the starting switch 17 is on, steps 204 and 209 are called to execute a starting subroutine wherein the valve opening period TOUT of the fuel injection valves 6 to be applied during starting operation of the engine 1 is calculated, and the fuel injection valves 6 are actuated to open over a period of time corresponding to the calculated TOUT value.

If the answer to the question of the step 203 is affirmative or Yes, that is, if the engine rotational speed Ne is higher than the predetermined cranking value NCR, or if the answer to the question of the step 205 is negative or No, that is, if the starting switch 17 is off, it is judged that the engine has got rid of the cranking state, and then the program proceeds to steps 206–208 to calculate the valve opening period TOUT of the fuel injection valves 6 to be applied after the engine starting operation has been finished. First, at the step 206, a value of a basic fuel injection quantity or valve opening period TOUT is read from a Ti map stored in the memory means 5c within the ECU 5, which corresponds to the sensed values of engine rotational speed Ne and intake pipe absolute pressure PBA.

Then, at the step 207 calculations are made of correction coefficients KAST, $KO_2$, other correction coefficients K1, and correction variables To. The correction coefficient KAST is an after-start fuel increasing coefficient (hereinafter merely called "fuel-increasing coefficient"), which is calculated by a KAST calculating subroutine, hereinafter described. The coefficient $KO_2$ is an $O_2$ feedback correction coefficient responsive to the concentration of oxygen $O_2$ sensed by the $O_2$ sensor 15 and calculated by a $KO_2$ caculating subroutine, hereinafter described. K1 are correction coeffcients other than KAST and $KO_2$, and To are correction variables as mentioned above, which are all set, based upon respective engine operating parameters, to appropriate values so as to optimize operating characteristics of the engine such as fuel consumption and emission characteristics.

At the step 208, the fuel injection period TOUT to be applied after the start of the engine is calculated in accordance with the following equation (1), by using the basic value Ti read at the step 206 and the correction coefficients KAST, $KO_2$ and K1 and correction variables To, followed by execution of the step 209 to actuate the fuel injection valves 6 on the basis of the calculated TOUT value:

$$TOUT = Ti \times KAST \times KO_2 K1 + To \quad (1)$$

Reference is now made to the subroutine for calculating the fuel increasing coefficient KAST and the subroutine for calculating the correction coefficient KO2.

Figure 3:
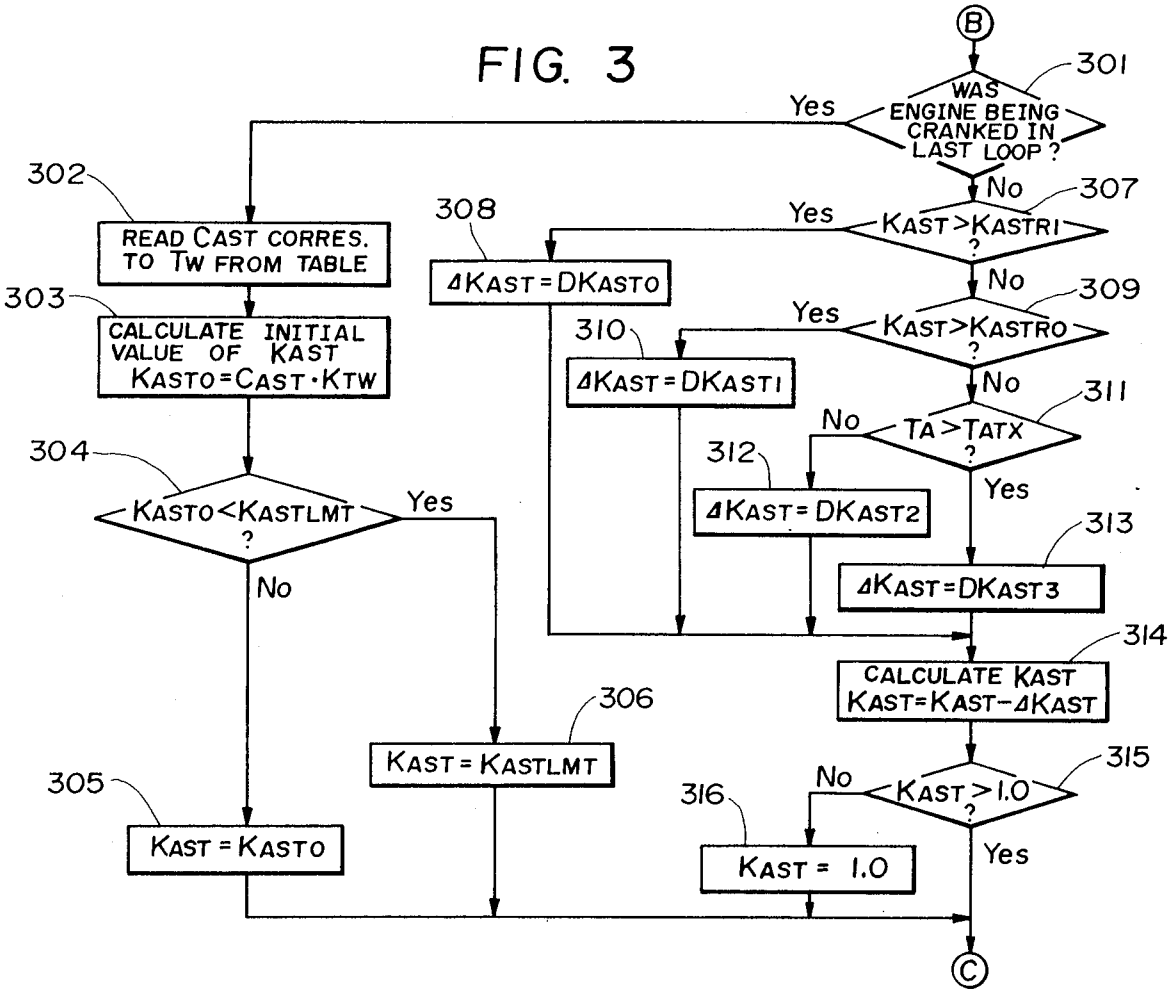
FIG. 3 is a flowchart of a subroutine for calculating an after-start fuel increasing coefficient KAST, which is executed at a step 207 in FIG. 2.

FIG. 3 shows the subroutine for calculating the fuel increasing coefficient KAST, which is executed at the step 207 in FIG. 2, each time a TDC signal pulse is generated. First, at a step 301 it is determined whether or not the engine was being cranked in the last loop. This determination is made in the same manner as in the steps 203 and 205 in FIG. 2. If the answer is affirmative or Yes, that is, if the present loop is the first one immediately after completion of the cranking operation of the engine 1, the program proceeds to a step 302 wherein a value CAST is determined from a table shown in FIG. 4 and stored within the memory means 5c, which corresponds to the engine coolant temperature TW. The value CAST is a calibration variable applied for calculating an initial value KAST0 of the fuel increasing coefficient KAST. In the table for determining this calibration variable CAST, shown in FIG. 4, there are provided two predetermined values TWAS1 (e.g. +10° C.) and TWAS2 (e.g. −10° C.) of the engine coolant temperature TW, wherein a predetermined value CAST2 (e.g. 1.1) is selected if the sensed coolant temperatuer TW is lower than the predetermined value TWAS2, and a predetermined value CAST1 (e.g. 1.0) when the sensed coolant temperature TW is higher than the predetermined value TWAS1, respectively. If the sensed coolant temperature TW falls between the values TWAS1 and TWAS1, a CAST value corresponding to the sensed coolant temperature TW is calculated by means of an interpolation method.

The calibration variable table may be set in various forms so as to conform to operating characteristics of engines applied. The engine coolant temperature applied for determining the CAST value is preferably sensed upon generation of a pulse of the TDC signal at the time of completion of the engine cranking operation.

Figure 5:
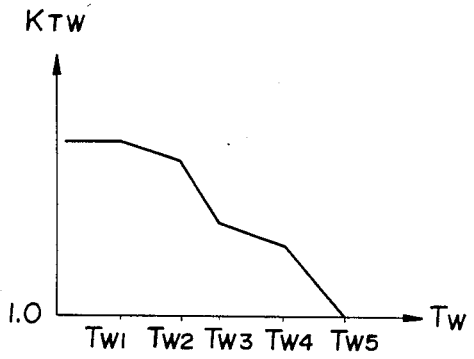
FIG. 5 is a graph shwoing a table of the relationship between a coolant temperature-dependent correction coefficient KTW and the and the engine coolant temperature TW.

Referring again to FIG. 3, the program then proceeds to a step 303 wherein the initial value KAST0 of the fuel increasing coefficient KAST is calculated according to the following equation (2) using the CAST value obtained as above:

$$KAST0 = CAST \times KTW \quad (2)$$

where KTW is the coolant temperature-dependent fuel increasing coefficient, referred to hereinbefore, and is determined from a table shown in FIG. 5 in response to the sensed coolant temperature TW. According to the FIG. 5 table, when the sensed coolant temperature TW is equal to or higher than a predetermined value TW5 (e.g. 60° C.), the KTW value is held at 1.0, and when the TW value is lower than the predetermined value TW5, one of a plurality of predetermined KTW values corresponding, respectively, to predetermined values TW1–TW4 is selected from the table. If the sensed coolant temperature TW falls between adjacent ones of the predetermined values TW1–TW5, the KTW value is determined by means of an interpolation method.

Figure 4:
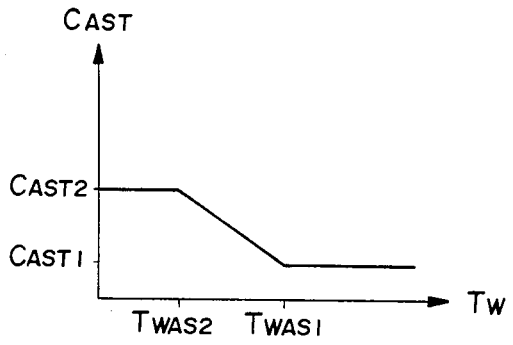
FIG. 4 is a graph showing a table of the relationship between a calibration variable CAST used for calculating an initial value KAST0 of the after-start fuel increasing coefficient KAST and engine coolant temperature TW.

It is to be noted from the CAST table of FIG. 4 and the KTW table of FIG. 5 as well as the equation (20), the initial value KAST0 of the fuel increasing coefficient KAST is set to smaller values as the engine coolant temperature TW is higher.

After the KTW value has thus been determined, the program then proceeds to a step 304 to determine whether or not the initial value KAST0 determined at the step 303 is larger than a predetermined lower limit KASTLMT (e.g. 1.2). If the answer is negative or No, the initial value KAST0 determined at the step 303 is directly applied as the coefficient KAST at a step 305, followed by termination of the program. If the answer to the question of the step 304 is affirmative or Yes, the predetermined lower limit KASTLMT is applied as the coefficient KAST, in place of the initial value KAST0 determined at the step 303, followed by termination of the program.

By thus providing the predetermined lower limit KASTLMT for the initial value KAST0 of the fuel increasing coefficient KAST, it can be ensured that the fuel quantity is increased, though at a minimum required rate, even after the engine has been restarted in a hot state where the engine coolant temperature TW is high, thereby preventing the mixture from being leaned.

The steps 302 through 306 for setting the fuel increasing coefficient KAST described above are executed only one time immediately after the engine cranking operation has been completed.

Figure 6:
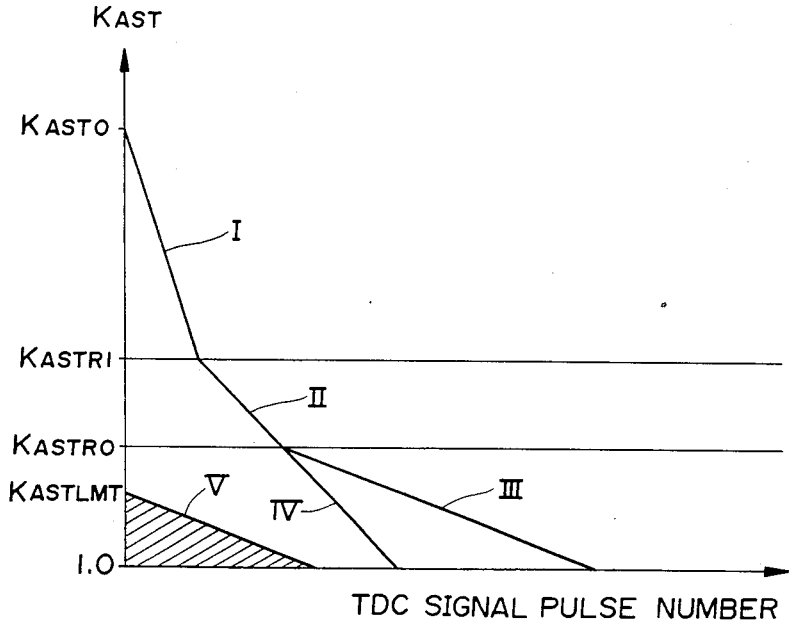
FIG. 6 is a graph showing manners of changes in the after-start fuel increasing coefficient KAST.

If the answer to the question of the step 301 is negative or No, that is, if the engine was not in a cranking state in the last loop, the program proceeds to a step 307 wherein it is determined whether or not the coefficient KAST is larger than a predetermined first value KASTR1 (e.g. 1.60) defining the KAST curve in FIG. 6. If the answer is affirmative or Yes, a decreasing constant ΔKAST is set to a first predetermined value DKAST0 at a step 308, while if the answer is negative or No, a step 309 is executed to determine whether or not the coefficient KAST is larger than a second predetermined value KASTR2 (e.g. 1.35) smaller than the first predetermined value KASTR1 and also defining the KAST curve in FIG. 6. If the answer is affirmative or Yes, that is, if KAST>KASTR0 stands, the decreasing constant ΔKAST is set to a second predetermined value DKAST1 which is smaller than the first predetermined value DKAST0, at a step 310, followed by the program proceeding to a step 314.

If the answer to the question of the step 309 is negative or No, that is, if KAST≦KASTR0 stands, the program proceeds to a step 311 wherein it is determined whether or not the sensed intake air temperature TA is higher than a predetermined value TATX (e.g. 70° C.) above which gas bubbles can be formed in the fuel within the fuel supply system of the engine such as the interior of the fuel injection valves 6. If the answer is negative or No, the program proceeds to a step 312 to set the decreasing constant ΔKAST to a third predetermined value DKAST2 which is smaller than the second predetermined value DKAST1. If the answer to the question of the step 311 is affirmative or Yes, the decreasing constant ΔKAST is set to a fourth predetermined value DKAST3 which is larger than the third predetermined value DKAST2, at a step 313, followed by the program proceeding to the step 314.

Then, at the step 314, the decreasing constant ΔKAST thus set in the step 308, 310, 312, or 313 is deducted from a value of the coefficient KAST applied in the last loop.

Then, it is determined at a step 315 whether or not the KAST value is larger than 1.0. If it is larger than 1.0, the program is immediately terminated.

Thereafter, the decrease of the coefficient KAST at the step 314 is repeatedly carried out each time a TDC signal pulse is generated, whereby the coefficient KAST is decreased along a bent line I-II-II, I-II-IV, or a line V shown in FIG. 6.

In this way, after the initial value KAST0 of the fuel increasing coefficient KAST has been set in response to the engine coolant temperature TW immediately after completion of the cranking operation, when the coefficient KAST has a value larger than the first predetermined value KASTR1, it is decreased at a higher rate as shown by the line I in FIG. 6; when the coefficient KAST lies between the first and second predetermined values KASTR1 and KASTR0, it is decreased at a smaller rate as shown by the line II in FIG. 6; and when the coefficient KAST is smaller than the second predetermined value KASTR0, it is decreased at different rates depending upon whether the sensed intake air temperature TA is higher than the predetermined value TATX, that is, as shown by the line III in FIG. 6 if TA is equal to or lower than TATX, and the line IV if TA is higher than TATX.

The solid line V in FIG. 6 shows a change in the fuel increasing coefficient KAST which is assumed after the engine has been started in a hot state. More specifically, although the engine coolant temperature TW then assumed is very high and accordingly the initial value KAST0 of the fuel increasing coefficient KAST is 1.0, it is set to the predetermined lower limit KASTLMT as stated before. The solid line V declines at the same decreasing rate as the solid line IV in FIG. 6 since the intake air temperature TA is higher than the predetermined value TATX. Thus, even after the start of the engine in a hot state, the KAST value is never set to a value within the hatched area in FIG. 6 and hence the fuel quantity is effectively increased after the start of the engine.

Referring again to FIG. 3, when the fuel increasing coefficient KAST is decreased to or below 1.0 as a result of the repeated execution of the deduction at the step 314, the answer to the question of the step 315 becomes negative or No, and then it is assumed that the after-start fuel increasing period has elapsed, and the fuel increasing coefficient KAST is set to 1.0 at a step 316, followed by termination of the program.

Figure 7:
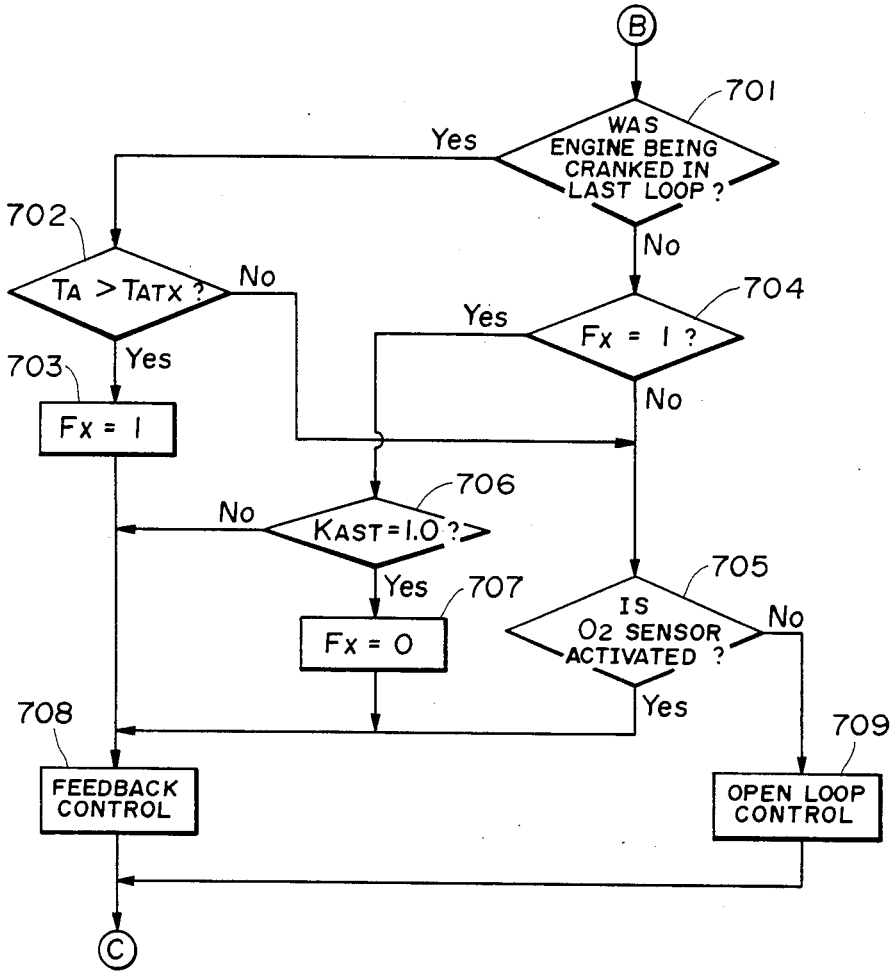
FIG. 7 is a flowchart of a subroutine for calculating an $O_2$ feedback correction coefficient $KO_2$, which is executed at the step 207 in FIG. 2.

FIG. 7 shows a subroutine for calculating the correction coefficient $KO_2$, which is executed at the step 207 in FIG. 2, each time a TDC signal pulse is generated.

First, it is determined at a step 701 whether or not the engine was being cranked in the last loop. If the answer is affirmative or Yes, that is, if the present loop is the first loop after the cranking operation is completed, the program proceeds to a step 702.

At the step 702, it is determined whether or not the intake air temperature TA is higher than the predetermined value TATX. If the answer is affirmative or Yes, that is, TA>TATX stands, it is assumed that the temperature within the fuel injection valves 6 arranged close to the intake air temperature sensor 9 for sensing the intake air temperature TA within the intake pipe 2 is also so high that gas bubbles are present in the boiling fuel within the fuel injection valves 6, and also that the $O_2$ sensor 15 is already activated. Therefore, a flag FX, which has been set to 0 at the start of execution of the present program, is set to 1 at a step 703, and then a step 708 is executed to carry out the air-fuel ratio feedback control by calculating the correction coefficient $KO_2$ and correcting the basic value Ti by the calculated coefficient $KO_2$, etc., followed by termination of the program.

If the answer to the question of the step 702 is negative or No, that is TA≦TATX stands, it is not clear whether or not the $O_2$ sensor 15 is activated, and then the program proceeds to a step 705 to determine activation of the $O_2$ sensor 15. This determination is effected based upon the manner of change of the internal resistance of the $O_2$ sensor 15, for instance. If the answer to the question of the step 705 is affirmative or Yes, that is, if the $O_2$ sensor 15 is activated, the step 708 is executed to carry out the feedback control. On the other hand, if the answer is negative or No, that is, if the $O_2$ sensor 15 is not activated, a step 709 is executed to carry out open loop control of the air-fuel ratio while the $KO_2$ value is held at a predetermined value, followed by termination of the program.

If the answer to the question of the step 701 is negative or No, that is, if the engine was not being cranked in the last loop, the program proceeds to a step 704 to determine whether or not the flag FX is 1. If the flag 703 has been set to 1 at the step 703, which means that the $O_2$ sensor 15 was assumed to have been activated, immediately after completion of the engine cranking, a step 706 is called wherein it is determined whether or not the fuel increasing coefficient KAST calculated by the KAST value calculating subroutine assumes a value of 1.0. If the KAST value has not been decreased to 1.0 as yet, it is assumed that the after-start fuel increasing period has not yet elapsed, the program proceeds to the step 708. On the other hand, if the KAST value has been decreased to 1.0 so that the after-start fuel increasing period is assumed to have elapsed, the flag FX is reset to 0 at a step 707, and then the program proceeds to the step 708 to carry out the feedback control, followed by termination of the program.

If the answer to the question of the step 704 is negative or No, that is, if the flag FX is not 1, which means that the step 703 was not executed in the last loop since $TA \leqq TATX$ stood in the step 702 and accordingly it was not clear whether or not the $O_2$ sensor 15 was activated, or if the step 707 was executed in the last loop, which means that the KAST was judged to assume 1.0 in the step 706, that is, the after-start fuel increasing period elasped, the program proceeds to the step 705 to determine whether or not the $O_2$ sensor 15 is activated. If the sensor is activated, the step 708 is executed, while if the sensor is not activated, the step 709 is executed, followed by termination of the program.

As described above, according to the method of the invention, once the engine has been started, the fuel increasing operation by the use of the fuel increasing coefficient is effected after the start of the engine without exception, and at the same time the fuel quantity correction by the use of the $O_2$ feedback correction coefficient $KO_2$ responsive to the $O_2$ sensor output is also effected if the engine is started in a hot state or if the $O_2$ sensor 15 is already activated. Since the fuel quantity increasing based upon the fuel increasing coefficient KAST and the fuel quantity correction based upon the correction coefficient $KO_2$ are carried out at the same time after the start of the engine in a hot state, the mixture can be prevented from being leaned due to the formation of gas bubbles in the fuel, and also the time period before no gas bubble is formed in the fuel can be shortened, by virtue of the fuel quantity correction by means of the correction coefficient $KO_2$. Further, by virtue of the concurrent fuel quantity increasing by means of the fuel increasing coefficient KAST, it can be avoided that the correction coefficient $KO_2$ undergoes a large change toward the mixture-enriching side, thus preventing the mixture from becoming overrich immediately after emission of the gas bubbles burnt and enabling to promptly bring the coefficient $KO_2$ to a proper value and thus securing stable driveability of the engine.

Incidentally, in the step 311 in FIG. 3 and in the step 702 in FIG. 7, the engine coolant temperature TW may be compared with a predetermined value TWTX above which it is assumed that gas bubbles can be formed in the fuel, instead of the intake air temperature TA.

What is claimed is:

1. In a method of controlling the supply of fuel to an internal combustion engine, including the steps of effecting after-start fuel increasing control wherein an initial value of a fuel increment is set to a value dependent upon a temperature of the engine upon generation of a predetermined control signal immediately after the start of the engine, the fuel increment is progressively decreased from the set initial value in synchronism with subsequent generation of the predetermined control signal, and a fuel quantity corrected by the progressively decreased fuel increment is supplied to the engine, and effecting air-fuel ratio feedback control, which is executed on condition that a predetermined feedback control condition is fulfilled after the start of the engine, wherein a correction coefficient has a value thereof set to a value dependent upon the concentration of an ingredient in exhaust gases emitted from the engine, sensed by sensor means arranged in an exhaust system of the engine, and a fuel quantity corrected by the set correction coefficient is supplied to the engine, the improvement comprising the steps of: (a) setting the initial value of the fuel increment to smaller values as the temperature of the engine is higher; (b) setting the initial value of the fuel increment to a predetermined lower limit if the initial value set depending upon the temperature of the engine is smaller than the predetermined lower limit; and (c) effecting the air-fuel ratio feedback control by correcting a fuel quantity to be supplied to the engine by the fuel increment together with the correction coefficient insofar as the predetermined feedback control condition is fulfilled, when the temperature of the engine is higher than a predetermined value at the start of the engine.

2. A method as claimed in claim 1, wherein the predetermined value of the temperature of the engine is a value above which gas bubbles can be formed in fuel to be supplied to the engine.

3. A method as claimed in claim 1 wherein the temperature of the engine is the temperature of intake air being supplied to the engine.

* * * * *